US005779101A

United States Patent [19]

Holmgren et al.

[11] Patent Number: 5,779,101

[45] Date of Patent: Jul. 14, 1998

[54] PORTABLE CARRIER FOR AEROSOL CONTAINERS AND METHOD THEREFOR

[75] Inventors: Vilma G. Holmgren, West Dundee; Joseph A. Hahn, Grayslake; Douglas G. Begley, Palatine; Thomas E. Perdue, Jr., Crystal Lake, all of Ill.

[73] Assignee: Illinois Tool Works Inc., Glenview, Ill.

[21] Appl. No.: 746,332

[22] Filed: Nov. 12, 1996

[51] Int. Cl.[6] ..... B67D 5/64

[52] U.S. Cl. ..... 222/130; 222/153.11; 222/182

[58] Field of Search ..... 222/130, 182, 222/153.01, 153.1, 153.11, 153.12, 402.11

[56] References Cited

U.S. PATENT DOCUMENTS

| | | | |
|---|---|---|---|
| 3,262,600 | 7/1966 | Gach | 222/153.11 |
| 3,602,399 | 8/1971 | Litman et al. | 222/153.11 |
| 3,729,119 | 4/1973 | Sette et al. | 222/153.11 |
| 3,738,536 | 6/1973 | Gach | 222/153.1 |
| 4,143,764 | 3/1979 | Moss, III . | |
| 4,194,619 | 3/1980 | Schley . | |
| 4,228,908 | 10/1980 | Tweeton . | |
| 4,782,945 | 11/1988 | Geiler et al. . | |
| 4,834,253 | 5/1989 | Crine . | |
| 4,919,295 | 4/1990 | Hitzler . | |
| 5,007,540 | 4/1991 | Beaslley et al. . | |
| 5,101,997 | 4/1992 | Bagwell et al. . | |
| 5,125,537 | 6/1992 | Slapin et al. . | |
| 5,135,823 | 8/1992 | Eales . | |
| 5,316,159 | 5/1994 | Douglas et al. . | |
| 5,335,813 | 8/1994 | Qi . | |
| 5,356,040 | 10/1994 | Reggiani . | |

*Primary Examiner*—Philippe Derakshani
*Attorney, Agent, or Firm*—Donald J. Breh

[57] ABSTRACT

A portable container carrier for housing aerosol containers and other articles having disposed on one end portion thereof an actuatable or removable cap. The portable carrier includes generally a housing member having a first cover member slidably coupled to a first end portion of the housing member, and a second cover member slidably coupled to a second end portion of the housing member. The cover members are movable relative to the housing member between an opened position and a closed position, wherein the aerosol container caps are enclosed within the carrier by the cover members in the closed position, and wherein the aerosol container caps protrude through apertures of the cover members in the opened position so that the containers are accessible without having to detachably remove the cover members from the housing member, and the containers are accessible and useable without having to remove the containers from the carrier.

10 Claims, 2 Drawing Sheets

PORTABLE CARRIER FOR AEROSOL CONTAINERS AND METHOD THEREFOR

CROSS REFERENCE TO RELATED APPLICATIONS

The present application is related to a co-pending application for an ornamental design entitled "Portable Carrier for Aerosol Containers or Similar Article", Attorney Docket No. 7887, U.S. application Ser. No. 29/064,072, filed on Nov. 12, 1996, assigned to the assignee of the present application.

BACKGROUND OF THE INVENTION

The invention relates generally to portable carriers for containers with an actuatable or removable cap disposed on an end portion thereof, and more specifically to portable carriers with a cover portion for housing cylindrical aerosol containers wherein the containers are enclosable in the portable carrier, and for selectively exposing the containers to provide access thereto without removing the containers from the portable carrier.

Portable carriers for housing containers having an actuatable or removable cap are known generally. In U.S. Pat. No. 4,228,908 entitled "Baby Bottle Carrier" issued on 21 Oct. 1980 to Tweeton, for example, one or more bottles are housed in a portable bottle carrier having an insulated base portion and one or more detachably connectable cover portions. Tweeton discloses several bottle carrier configurations for housing one or more bottles arranged either side by side or stacked one above the other. The bottles in Tweeton, however, are not generally used while housed in the base portion of the carrier. This is particularly so where the bottle carriers are configured for housing multiple bottles. Tweeton thus discloses detachably connectable cover portions, which are frictionally or threadedly coupled to the base portion to cover the bottles housed therein, wherein the cover portions are detachable, or separateable, from the base portion of the carrier to provide access to the bottles housed therein and to permit removal of the bottles therefrom.

The inventors of the present invention recognize that there are other applications where it is desirable to house several containers with an actuatable or removable cap on one end thereof in a portable container carrier, wherein the containers or corresponding portions of the containers are selectively accessible without the having to completely detach, or separate, a cover portion from another portion of the carrier. The inventors recognize further that there are applications where it is desirable to securely enclose containers within the container carrier without the risk of unintended exposure of the containers, and also to provide unobstructed access to the containers housed in the carrier. And still further, that in some applications it is desirable to access the exposed portions of the containers housed in the carrier without having to remove or separate the containers from the carrier. Yet these features and combinations of these features are not known in existing portable container carriers.

One such application where many of said features are desirable is in the packaging of liquid penetrant inspection systems, which are used on-sight, or in the field, for detecting fractures in metal articles. These liquid penetrant inspection systems generally include two or three or more miniature aerosol containers containing dyes and other agents, which are applied in combination to a metal material to reveal fractures otherwise not readily visible to the naked eye. For this type of application, which is only exemplary, it is desirable to house several of the aerosol containers in a single common portable carrier for convenience of use in the field. It is desirable to provide a portable carrier that permits access to the containers housed therein without having to detachably separate a cover portion from other portions of the carrier. It is desirable to securely enclose the aerosol containers in the carrier to prevent the unintentional dispensing of dyes and agents therefrom, which may be harmful. It is desirable also to selectively expose a valve actuator cap of the aerosol containers without obstruction from the cover, and to dispense fluids from the containers housed in the carrier without having to remove the aerosol containers from the carrier.

In view of the discussion above, among other considerations, there exists a demonstrated need for an advancement in the art of portable container carriers.

It is therefore an object of the invention to provide novel portable container carriers and methods therefor that overcome problems in the prior art.

It is also an object of the invention to provide novel portable container carriers and methods for housing a plurality of containers with an actuatable or removable cap in a common portable carrier having a housing member with first and second cover members slidably coupled to end portions of the housing member, wherein the containers are accessible without having to detachably remove the cover members from the housing member, and wherein the containers housed in the carrier are accessible and useable without having to remove or separate the containers from the carrier.

It is another object of the invention to provide novel portable container carriers and methods for housing a plurality of containers with an actuatable or removable cap in a common portable carrier having housing member with first and second locking members on corresponding first and second end portions of the housing member, and first and second cover members slidably coupled to corresponding end portions of the housing member, wherein the locking members are engageable with portions of corresponding cover members for securely retaining the cover members in either an opened position or in a closed position.

It is another object of the invention to provide novel portable container carriers and methods for housing a plurality of aerosol containers with a valve actuator cap in a pocket size portable carrier having housing member with first and second cover members slidably coupled to corresponding first and second end portions of the housing member, and at least two aerosol containers disposeable in each of two corresponding container cavities in the first and second end portions of the housing member. The first and second cover members are slidably movable relative to the housing member between an opened position and a closed position, wherein the aerosol container caps protrude through apertures of the cover members in the opened position, and the aerosol container caps are enclosed within the carrier by the cover members in the closed position.

These and other objects, features and advantages of the present invention will become more fully apparent upon consideration of the following Detailed Description of the Invention with the accompanying Drawings, which may be disproportionate for ease of understanding, wherein like structure and steps are referenced by corresponding numerals and indicators.

DETAILED DESCRIPTION OF THE INVENTION

Figure 1:
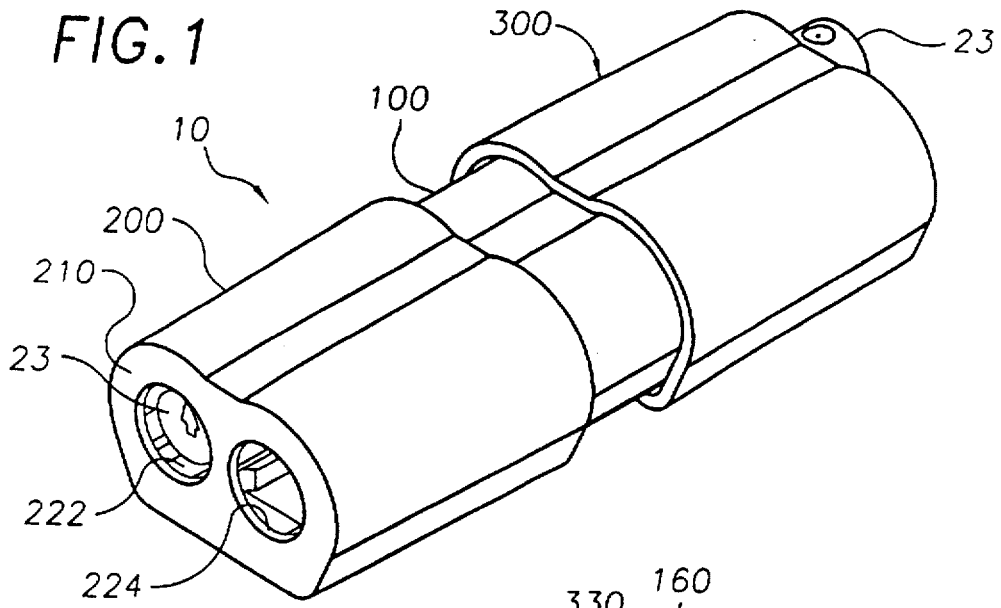
FIG. 1 is a top side perspective view of a portable container carrier having a housing member for receiving a plurality of aerosol containers and first and second cover members slidably coupled to corresponding end portions of the housing member according to an exemplary embodiment of the invention.
Figure 2:
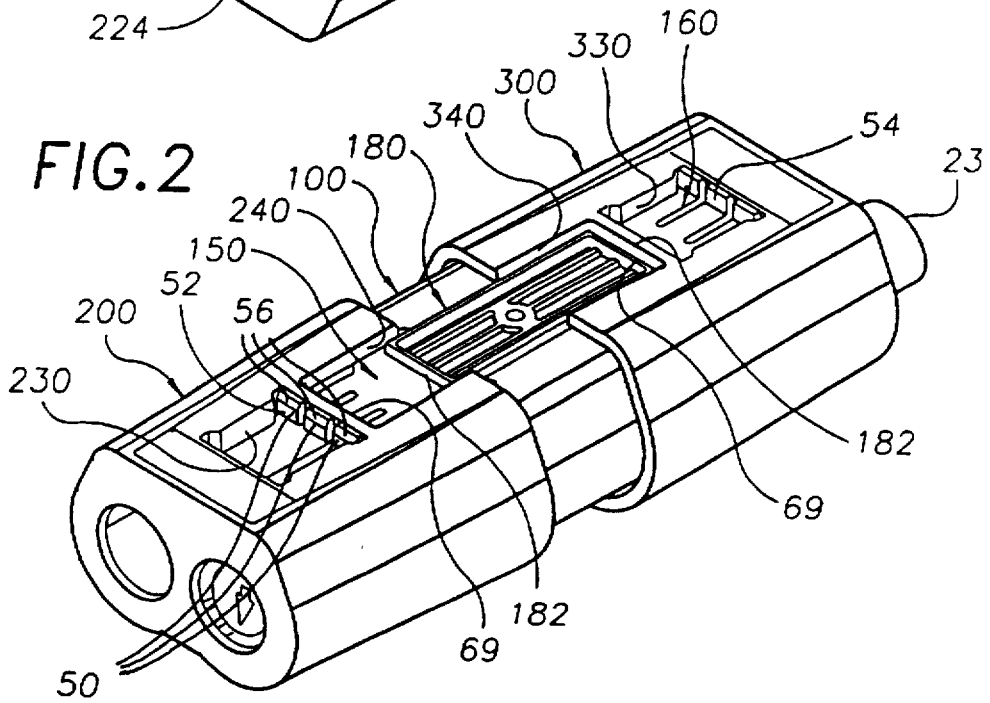
FIG. 2 is a bottom side perspective view of the carrier of FIG. 1.
Figure 5:
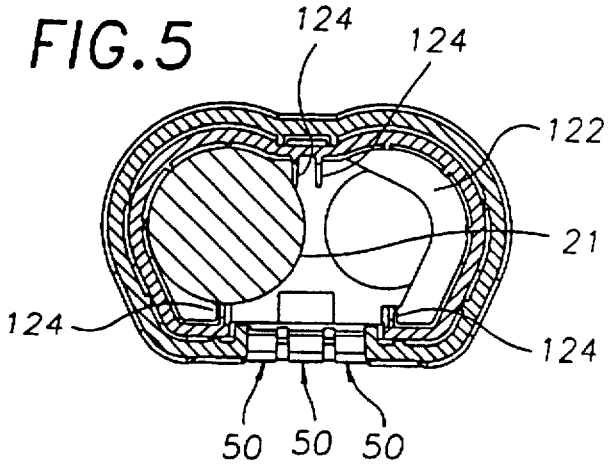
FIG. 5 is a third sectional view of the carrier taken along lines D—D of FIG. 4.
Figure 4:
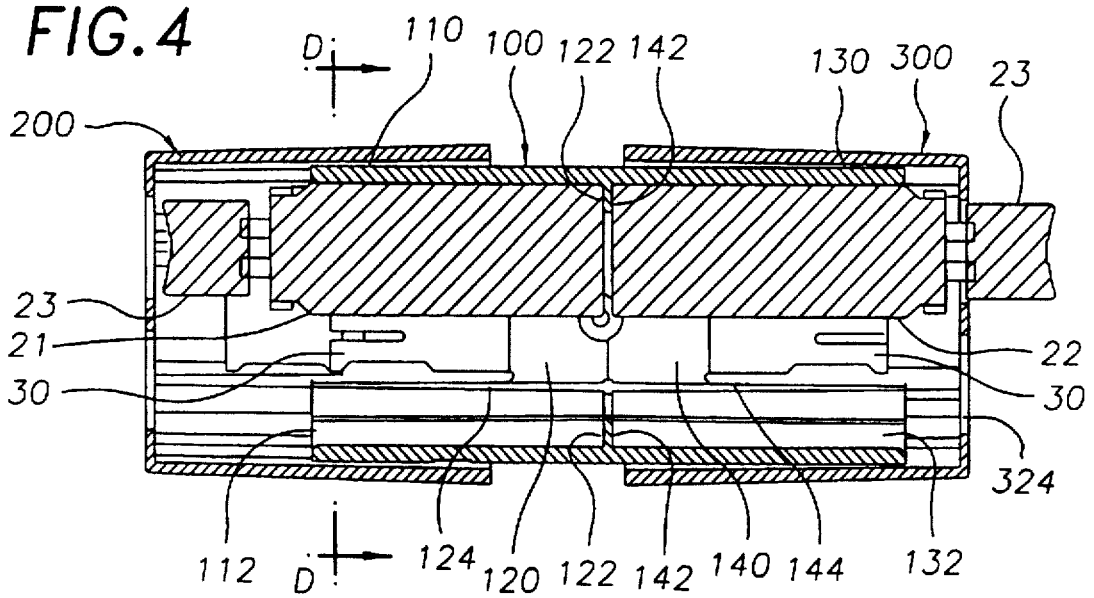
FIG. 4 is a second sectional view of the carrier taken along lines C—C of FIG. 3.
Figure 3:
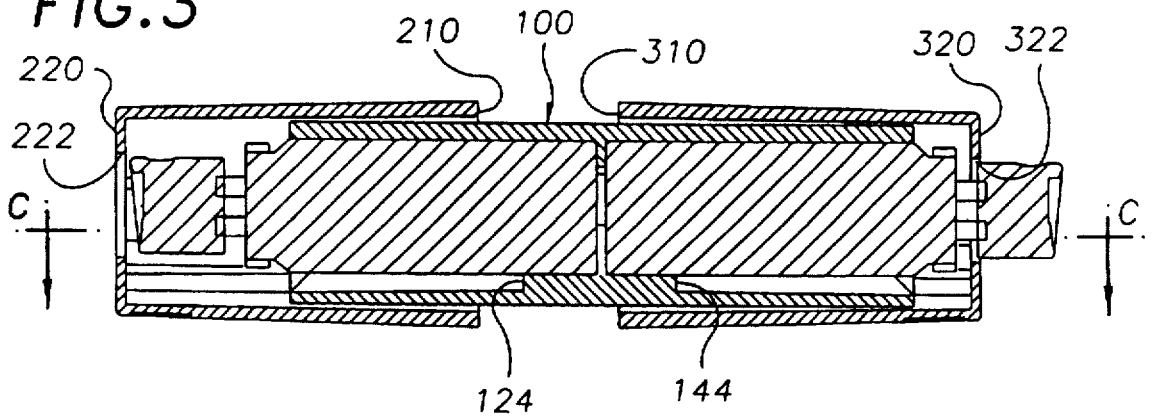
FIG. 3 is a first sectional view of the carrier of FIG. 1.

FIGS. 1 and 2 are perspective views of a portable carrier 10 for housing a plurality of at least two containers 21, 22 with a corresponding valve actuator cap 23 disposed on an end portion of each container, which are also shown in FIGS. 3–5. In the exemplary embodiments of the invention, the containers 21, 22 are cylindrical aerosol containers with a valve actuator cap on an end portion thereof. More generally, however, the carrier 10 is useful for housing other containers having disposed on an end portion thereof an actuatable or removable cap, or still more generally any article with end portion to which selective access is desired.

According to one aspect of the invention, the carrier 10 comprises generally a housing member 100 having a first cover member 200 slidably coupled to a first end portion 110 of the housing member 100, and a second cover member 300 slidably coupled to a second end portion 130 of the housing member 100, wherein the cover members 200, 300 are movable relative to the housing member 100 between an opened position and a closed position. FIGS. 1 and 2 show, for example, the first cover member 200 in the closed position wherein the first container 21 is enclosed, or covered, by the closed cover member 200, and the second cover member 300 in the opened position wherein the cap 23 of the second container 22 is exposed, or protrudes, through the opened cover member 300 to provide access thereto. In one embodiment, the components of the carrier 10 are manufactured of plastic materials like Delrin™ in a molding operation, although the carrier 10 may alternatively be manufactured from other materials including metals in other fabricating operations.

FIGS. 3 and 4 show the housing member 100 including a first end portion 110 with a first opening 112 defining a first container cavity 120 for receiving the first container 21, and a second end portion 130 with a second opening 132 defining a second container cavity 140 for receiving the second container 22. In the exemplary embodiment, the first end portion 110 of the housing member 100 substantially opposes the second end portion 130 of the housing member, but this symmetry along a common axis is not required. And in other embodiments, the first and second cavities 120 and 140 may be configured about different intersecting axes.

In FIG. 3, the first cover member 200 includes an open end portion 210 and a closed end portion 220 having at least one aperture 222, and the second cover member 300 includes an open end portion 310 and a closed end portion 320 having at least one aperture 322. In the exemplary embodiment, the open end portion 210 of the first cover member 200 is slidably disposeable over the first end portion 110 of the housing member 100, and the open end portion 310 of the second cover member 300 is slidably disposeable over the second end portion 130 of the housing member 100. According to this aspect of the invention, the first valve actuator cap 23 of the first container 21 received in the first container cavity 120 protrudes through the aperture 222 of the first cover member 200 when the first cover member 200 is in the opened position, and the first valve actuator cap 23 of the first container 21 received in the first container cavity 120 is covered by the first cover member 200 when the first cover member 200 is in the closed position. The second cover member 300 is similarly movable relative to the housing member 100 to expose and enclose the cap 23 of the second container 22 received in the second container cavity 140 of the housing member 100.

According to the exemplary embodiments of FIGS. 3–5, the first container cavity 120 of the housing member 100 also includes a first end plate 122 and a first plurality of resilient rib members 124 protruding into the first container cavity 120. The first end plate 122 forms a base on which two first containers 21 are mountable side by side, and the resilient rib members 124 are arranged to frictionally engage and retain the two first cylindrical containers 21 in the first container cavity 120. Only one of the two first cylindrical containers 21 is shown in the FIGS. for clarity. The minimum number of resilient rib members 124 required for retaining each first container 21 depends on the specific shape of the container cavity 120 and the specific shape of the container 21. According to a related aspect of the invention, the closed end portion 210 of the first cover member 200 also includes two apertures 222 and 224 to provide access to, or expose, two first valve actuator caps 23 corresponding to the two first cylindrical containers 21 receivable in the first container cavity 120. According to this configuration and shown in FIGS. 1–4, the two valve actuator caps 23 protrude through the two apertures 222, 224 in the first cover member 200 when the first cover member 200 is in the opened position, and the two first valve actuator caps 23 are covered by the first cover member 200 when the first cover member 200 is in the closed position.

The second container cavity 140 of the housing member 100 also includes a second end plate 142 and a second plurality of resilient rib members 144 protruding into the second container cavity 140, and the closed end portion 310 of the second cover member 300 also includes two apertures 322 and 324 to provide access to, or expose, two second valve actuator caps 23 corresponding to the two second cylindrical containers 22 receivable in the second container cavity 140 as discussed above with respect to the first container cavity 120. In the exemplary embodiment, the first end plate 122 and the second end plate 142 are formed by opposing sides of a common plate having a substantially annular shape.

According to a more general aspect of the invention, the first opening 112 at the first end portion 110 of the housing member 100 defines a plurality of first container cavities for receiving a corresponding plurality of more than two first containers, and the first cover member 200 includes a corresponding plurality of apertures in the closed end portion of the first cover member 200. Alternatively, the first container cavity 120 may include a plurality of ribs 124 which effectively partitions the first container cavity 120 for receiving the plurality of more than two first containers. According to these aspects of the invention, a plurality of first valve actuator caps corresponding to the plurality of first containers receivable in the plurality of first container cavities protrude through the plurality of corresponding apertures of the first cover member 200 when the first cover member is in the opened position, and the plurality of first valve actuator caps are covered by the first cover member 200 when the first cover member 200 is in the closed position. Similarly, the second opening 132 at the second end portion 130 of the housing member 100 defines a plurality of second container cavities for receiving a corresponding plurality of second containers, and the second cover member 300 includes a corresponding plurality of apertures in the closed end portion of the second cover member 300, which is operable as discussed above with respect to the first cover member 200.

According to another aspect of the invention, shown generally in FIG. 2, the housing member 100 includes a first locking member 150 disposed on the first end portion 110 of the housing member 100 and a second locking member 160 disposed on the second end portion 130 of the housing member 100. The first locking member 150 of the housing member 100 is movable in a first slot 230 in the first cover member 200 as the first cover member 200 is moved between the opened position and the closed position discussed above. The first locking member 150 is engageable with a first portion of the first slot 230 to retain the first cover member 200 in the closed position, and the first locking member 150 is engageable with a second portion of the first slot 230 to retain the first cover member 200 in the opened position. The second locking member 160 of the housing member 100 is movable similarly in a second slot 330 in the second cover member 300 as the second cover member 300 is moved between the opened position and the closed position discussed above. Similarly, the second locking member 160 is engageable with a first portion of the second slot 330 to retain the second cover member 200 in the closed position, and the second locking member 160 is engageable with a second portion of the second slot 230 to retain the second cover member 300 in the opened position.

Figure 6A:
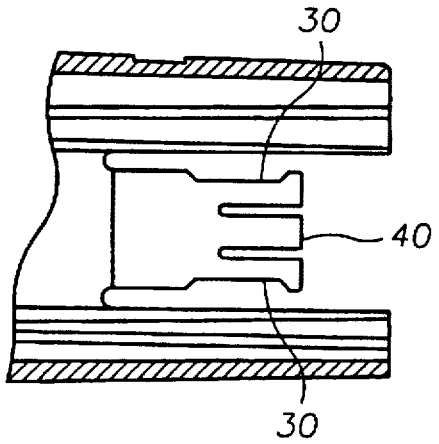
FIG. 6*a* is a partial sectional view of the carrier housing member including a locking member portion thereof.
Figure 6B:
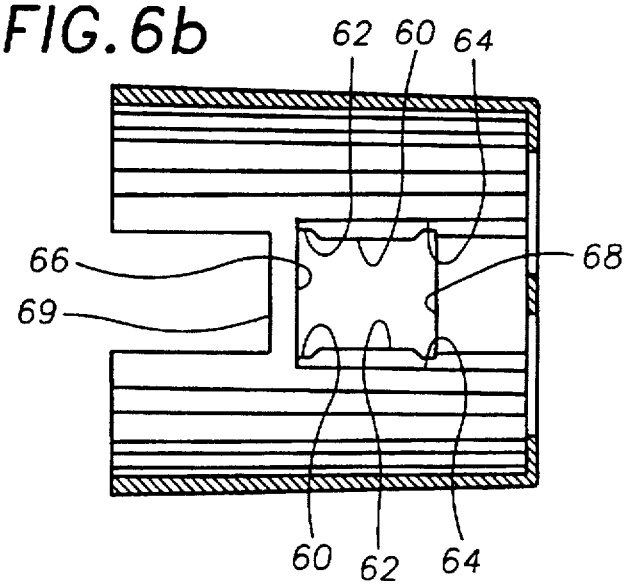
FIG. 6*b* is a partial sectional view of a carrier cover member having a slot with portions for cooperatively interacting with a locking member of the carrier housing member according to an exemplary embodiment of the invention.

In the exemplary embodiment of FIG. 6*a*, each of the first and second locking members 150 and 160 has three resilient arms including two outermost resilient arms 30 and an inner resilient arm 40. FIGS. 2 and 5 show each resilient arm 30, 40 including a protruding foot portion 50 extending outwardly away from the housing member 100. According to a related aspect of the invention shown in FIG. 6*b*, the slot 230, 330 of each of the first and second cover members 200, 300 includes opposing lateral side portions 60 having a closed engagement recess 62 and an opened engagement recess 64 located on each of the opposing lateral side portions 60. The slot 230, 330 of each of the first and second cover members 200, 300 also includes a cover closed stop 66 and a cover opened stop 68 on opposing ends thereof.

According to this configuration, the resilient arms 30, 40 are flexible inwardly toward the housing member 100 to permit the cover members 200, 300 to slide over the corresponding end portions 110, 130 of the housing member 100. FIG. 2 shows the outwardly protruding foot portions 50 of the first and second locking member 150, 160 protruding into a corresponding slot 230, 330 as the cover member 200, 300 is disposed about an end portion of the housing member 100. According to this configuration shown in FIGS. 2 and 6, a first surface 52 of each protruding foot portion 50 is engageable with the cover opened stop 68 when the cover member is moved to the opened position, and a second surface 54 of each protruding foot portion 50 is engageable with the cover closed stop 66 when the cover member is moved to the closed position, whereby the protruding foot portions 50 in cooperation with the cover closed stop 66 and the cover opened stop 68 limit movement of the corresponding cover members 200, 300 relative to the housing member 100 beyond the opened and closed positions.

According to a related aspect of the invention shown in FIG. 2, each of the protruding foot portions 50 include a bevelled surface portion 56 for engaging a portion 69 of the cover member 200, 300 when the resilient arms 30, 40 are flexed slightly inwardly. According to this configuration, as the slightly inwardly flexed beveled surfaces 56 engage the portion 69 of the cover members 200, 300, the resilient arms 30, 40 are more fully inwardly flexed to facilitate slidably disposing the cover members 200, 300 over the corresponding end portions housing member 100.

According to another aspect of the invention, the outermost resilient arms 30 are flexible laterally toward and away form each other to lock, or retain, the cover members 200, 300 in the opened position and in the closed position. FIGS. 2 and 6 show the protruding foot portions 50 of the outermost resilient arms 30 biased into engagement with a corresponding closed engagement recess 62 on the opposing lateral side portions 60 of the slot when the cover member is in the closed position relative to the housing member 100, and the protruding foot portions 50 of the outermost resilient arms 30 biased into engagement with a corresponding opened engagement recess 64 located on the opposing lateral side portions 60 of the slot when the cover member is in the opened position relative to the housing member 100. As the cover members 200, 300 are moved between the opened and closed positions relative to the housing member 100, the outermost resilient arms 30 are flexed inwardly toward each other by the opposing lateral side portions 60 of the slot until the cover members 200, 300 are moved to the opened or closed position, whereupon the protruding foot portions 50 of the outer most resilient arms 30 are biased into the corresponding recesses 64 or 62, respectively. According to an alternative configuration, the first and second locking member 150, 160 include only the two outermost resilient arms 30.

According to another aspect of the invention shown in FIG. 2, the housing member 100 includes a guide member 180 protruding from the housing member 100 along an elongate dimension of the housing member 100 between the first opening 112 of the housing member 100 and the second opening 132 of the housing member 100. The first cover member 200 and the second cover member 300 each include a first guide recess 240, 340 for receiving a portion of the guide member 180 of the housing member 100 when the cover members 200, 300 are moved between the closed position and the opened position relative to the housing member 100. FIG. 2 shows the first cover member 100 in the closed position wherein the first container 21 is covered and enclosed within the carrier 10, and the second cover member 300 in the opened position wherein the cap 23 of the second container 22 protrudes through the second cover member 300. According to this configuration, the guide member 180 is movable in and out of the first and second guide recesses 240, 340 when the cover members 200, 300 are moved between the opened and closed positions to facilitate and guide the sliding movement of the cover members 200, 300 relative to the housing member 100. Opposing end portions 182 of the guide member 180 may also engage portions 69 of the cover members 200, 300 to provide an alternate or additional engagement surface when the cover members 200, 300 are in the opened position.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A portable carrier for housing a plurality of at least two containers of the type having a valve actuator cap disposed on an end portion of the container, the carrier comprising:

an housing member having a first end portion with a first opening defining a first container cavity for receiving a first container, the housing member having a second end portion with a second opening defining a second container cavity for receiving a second container;

a first cover member having an open end portion and a closed end portion having at least one aperture, the first cover member slidably coupled to the first end portion of the housing member, and the first cover member movable between a closed position and an opened position relative to the housing member;

a second cover member having an open end portion and a closed end portion having at least one aperture, the second cover member slidably coupled to the second end portion of the housing member, and the second cover member movable between a closed position and an opened position relative to the housing member, whereby a first valve actuator cap of a first container received in the first container cavity of the housing member protrudes through the at least one aperture of the first cover member when the first cover member is in the opened position, and the first valve actuator cap of the first container received in the first container cavity of the housing member is covered by the first cover member when the first cover member is in the closed position, whereby a second valve actuator cap of a second container received in the second container cavity of the housing member protrudes through the at least one aperture of the second cover member when the second cover member is in the opened position, and the second valve actuator cap of the second container received in the second container cavity of the housing member is covered by the second cover member when the second cover member is in the closed position.

2. The portable carrier of claim 1, the open end portion of the first cover member slidably disposeable over the first end portion of the housing member, and the open end portion of the second cover member sidably disposeable over the second end portion of the housing member.

3. The portable carrier of claim 1 further comprising:

a first locking member disposed on the first end portion of the housing member and a second locking member disposed on the second end portion of the housing member;

a first slot in the first cover member, the first locking member of the housing member engageable with a first portion of the first slot to retain the first cover member in the closed position, and the first locking member engageable with a second portion of the first slot to retain the first cover member in the opened position; and a second slot in the second cover member, the second locking member of the housing member engageable with a first portion of the second slot to retain the second cover member in the closed position, and the second locking member engageable with a second portion of the second slot to retain the second cover member in the opened position.

4. The portable carrier of claim 3, further comprising:

the first locking member having at least two resilient arms, each arm having an outwardly protruding foot portion;

the second locking member having at least two resilient arms, each arm having an outwardly protruding foot portion;

a closed engagement recess located on opposing lateral side portions of the first slot in the first cover member, and an opened engagement recess located on the opposing lateral side portions of the first slot in the first cover member;

a closed engagement recess located on opposing lateral side portions of the second slot in the second cover member, and an opened engagement recess located on the opposing lateral side portions of the second slot in the second cover member, whereby the foot portions on the resilient arms of the first locking member are engageable with the closed engagement recesses in the first slot to retain the first cover member in the closed position, and the foot portions on the resilient arms of the first locking member are engageable with the opened engagement recesses in the first slot to retain the first cover member in the opened position, whereby the foot portions on the resilient arms of the second locking member are engageable with the closed engagement recesses in the second slot to retain the second cover member in the closed position, and the foot portions on the resilient arms of the second locking member are engageable with the opened engagement recesses in the second slot to retain the second cover member in the opened position.

5. The portable carrier of claim 1, the first opening at the first end portion of the housing member defining a plurality of first container cavities for receiving a corresponding plurality of first containers, the first cover member having a corresponding plurality of apertures in the closed end portion of the first cover member, whereby a corresponding plurality of first valve actuator caps of the plurality of first containers receivable in the plurality of first container cavities of the housing member protrude through the plurality of apertures of the first cover member when the first cover member is in the opened position, and the plurality of first valve actuator caps of the plurality of first containers received in the plurality of first cavities of the housing member are covered by the first cover member when the first cover member is in the closed position.

6. The portable carrier of claim 1, the first container cavity of the housing member having a first end plate and a first plurality of resilient rib members protruding into first container cavity for retaining two first cylindrical containers in the first container cavity, the closed end portion of the first cover member having two apertures, whereby two first valve actuator caps corresponding to the two first cylindrical containers receivable in the first container cavity of the housing member protrude through the two apertures in the first cover member when the first cover member is in the opened position, and the two first valve actuator caps corresponding to the two first cylindrical containers receivable in the first container cavity of the housing member are covered by the first cover member when the first cover member is in the closed position, the second container cavity of the housing member having a second end plate and a second plurality of resilient rib members protruding into second container cavity for retaining two second cylindrical containers in the second container cavity, the closed end portion of the second cover member having two apertures, whereby two second valve actuator caps corresponding to the two second cylindrical containers receivable in the second container cavity of the housing member protrude through the two apertures in the second cover member when the second cover member is in the opened position, and the two second valve actuator caps corresponding to the two second cylindrical containers receivable in the second container cavity of the housing member are covered by the second cover member when the second cover member is in the closed position.

7. The portable carrier of claim 1, further comprising:

a guide member protruding from the housing member along an elongate dimension of the housing member between the first opening of the housing member and the second opening of the housing member;

the first cover member including a first guide recess for receiving a portion of the guide member of the housing member when the first cover member is moved between the closed position and the opened position relative to the housing member; and the second cover member including a second guide recess for receiving a portion of the guide member of the housing member when the second cover member is moved between the closed position and the opened position relative to the housing member.

8. A method for portably carrying a plurality of at least two containers of the type having a valve actuator cap disposed on an end portion of the container, the method comprising steps of:

receiving a first container in a first container cavity disposed in a first end portion of a housing member;

receiving a second container in a second container cavity disposed in a second end portion of the housing member, the first end portion of the housing member substantially opposing the second end portion of the housing member;

slidably coupling a first cover member to the first end portion of the housing member, the first cover member having an open end portion and a closed end portion having at least one aperture;

sliding the first cover member relative to the housing member to an opened position, whereby a first valve actuator cap of a first container received in the first container cavity of the housing member protrudes through the at least one aperture of the first cover member when the first cover member is in the opened position;

sliding the first cover member relative to the housing member to a closed position, whereby the first valve actuator cap of the first container received in the first container cavity of the housing member is covered by the first cover member when the first cover member is in the closed position;

slidably coupling a second cover member to the second end portion of the housing member, the second cover member having an open end portion and a closed end portion having at least one aperture;

sliding the second cover member relative to the housing member to an opened position, whereby a second valve actuator cap of a second container received in the second container cavity of the housing member protrudes through the at least one aperture of the second cover member when the second cover member is in the opened position;

sliding the second cover member relative to the housing member to a closed position, whereby the second valve actuator cap of the second container received in the second container cavity of the housing member is covered by the second cover member when the second cover member is in the closed position.

9. The method of claim 8 further comprising steps of sliding the first cover member over the first end portion of the housing member, and sliding the second cover member over the second end portion of the housing member.

10. The method of claim 8 further comprising steps of:

engaging a first locking member disposed on the first end portion of the housing member with a first portion of a first slot in the first cover member to retain the first cover member in the closed position;

engaging the first locking member disposed on the first end portion of the housing member with a second portion of the first slot in the first cover member to retain the first cover member in the opened position;

engaging a second locking member disposed on the second end portion of the housing member with a first portion of a second slot in the second cover member to retain the second cover member in the closed position; and engaging the second locking member disposed on the second end portion of the housing member with a second portion of the second slot in the second cover member to retain the second cover member in the opened position.

* * * * *